US007475869B2

(12) United States Patent
Dennis

(10) Patent No.: US 7,475,869 B2
(45) Date of Patent: Jan. 13, 2009

(54) TENSIONING DEVICE FOR POLYMER FENCING

(76) Inventor: Russell Dennis, 229 Austerlitz Rd., Paris, KY (US) 40361

( * ) Notice: Subject to any disclaimer, the term of this patent is extended or adjusted under 35 U.S.C. 154(b) by 0 days.

(21) Appl. No.: 10/763,630

(22) Filed: Jan. 24, 2004

(65) Prior Publication Data

US 2005/0161657 A1 Jul. 28, 2005

(51) Int. Cl.
*E04H 17/02* (2006.01)

(52) U.S. Cl. ..... 256/42; 256/40; 256/41; 254/217; 254/223

(58) Field of Classification Search ..... 256/37, 256/40–42, 44; 242/388; 254/213, 214, 254/217, 222, 223
See application file for complete search history.

(56) References Cited

U.S. PATENT DOCUMENTS

| | | | | |
|---|---|---|---|---|
| 262,839 | A | 8/1882 | Shondy, Jr. et al. | |
| 471,979 | A | 3/1892 | Kellogg | |
| 813,574 | A | 2/1906 | McNames | |
| 1,229,343 | A | 6/1917 | Stevens | |
| 1,520,628 | A | 12/1924 | Anderson | |
| 2,449,600 | A | 9/1948 | Geiger | 248/361 |
| 2,560,845 | A | 7/1951 | Carpenter et al. | 248/68 |
| 2,571,347 | A | 10/1951 | Dodd | 256/43 |
| 2,991,975 | A * | 7/1961 | Alexander | 410/103 |
| 3,037,253 | A | 6/1962 | Barna | 24/68 |
| 3,290,010 | A * | 12/1966 | Holmes | 24/269 |
| 3,866,871 | A | 2/1975 | Dupuy, Sr. | 248/59 |
| 3,884,450 | A | 5/1975 | Brammer | 254/164 |
| 4,232,845 | A | 11/1980 | Turner | 248/49 |
| 4,245,806 | A | 1/1981 | Vangreen | 248/59 |
| 4,901,957 | A | 2/1990 | Daigle et al. | 248/62 |
| 4,911,387 | A | 3/1990 | Daiglo et al. | 248/62 |
| 5,193,769 | A | 3/1993 | Hofle | 248/69 |
| 5,219,427 | A | 6/1993 | Harris | 248/59 |
| 5,921,509 | A | 7/1999 | Flood et al. | 248/58 |
| 5,924,655 | A | 7/1999 | Rinderer | 248/55 |
| 6,102,371 | A | 8/2000 | Wyers | 254/218 |
| 6,390,421 | B1 | 5/2002 | Rudd | 248/68.1 |
| 6,547,218 | B2 * | 4/2003 | Landy | 254/217 |
| 6,648,305 | B2 * | 11/2003 | House et al. | 356/40 |
| 6,808,164 | B2 * | 10/2004 | Chang | 254/217 |
| 6,824,121 | B2 * | 11/2004 | Boice | 254/223 |
| 6,848,678 | B2 * | 2/2005 | Reiff | 256/44 |

* cited by examiner

*Primary Examiner*—Michael P Ferguson
(74) *Attorney, Agent, or Firm*—Laurence R. Letson

(57) ABSTRACT

A fence tensioner has a frame which may be rigid or articulated. The tensioner carries on each end thereof a rotatable cylindrical member which is provided with an axial slot to accommodate the profile of a section of fence. The cylindrical member is provided a ratchet and a pawl to lock the cylinder against loosening rotation. The pawl has a square end to lock the ratchet and eliminate any backlash and any slack in the fence members. The frame of the device is articulated so that each end of the device may accommodate the angle of the fence relative to the post. The vinyl fencing fits into the tensioner and locks itself therein as the cylinder rotates.

6 Claims, 3 Drawing Sheets

TENSIONING DEVICE FOR POLYMER FENCING

TECHNICAL FIELD OF THE INVENTION

The present invention relates, in general, to a tensioning device for flexible members such as polymer fencing. More particularly, the invention relates to a tensioning device that may be affixed to any standard fence post and may be used to apply tension to any flexible member and, more specifically, a polymer fencing member having a plurality of steel wires encapsulated therein.

BACKGROUND OF THE INVENTION

It is known in the art to utilize fencing to confine livestock in a defined area. Various types of fencing are available including wood, wire, barbed wire, chain link, and polymer fencing. In comparison to other types of fencing, polymer fencing provides significant advantages in terms of cost, aesthetics, visibility, and reduced risk of harm to any confined animals.

Numerous prior art polymer fencing systems are known. For example, U.S. Pat. No. 4,374,798 to Mercer discloses a plastic mesh structure suitable for use as fencing. Another particularly preferred polymer fencing system is disclosed in U.S. Pat. No. 4,465,263 to Robbins, Jr. (now U.S. Pat. No. Re. 32,707), comprising an elongated vinyl plastic webbing having parallel strands of high tensile wire encased therein. This latter fencing is designed to imitate wood fencing in terms of aesthetics while advantageously reducing the cost of purchase and maintenance associated with wood fencing. Both U.S. Pat. Nos. 4,374,798 and 4,465,263 are incorporated herein by reference.

In order for the fencing system to be effective regardless of the type of polymer fencing utilized, it must be placed under sufficient tension to prevent sagging of individual fencing members or strands. Standard tensioning devices for wire or barbed wire-type fencing are highly effective for their intended purpose. However, they suffer from the limitation that only a single strand of wire can be tensioned at a time. Accordingly, single wire prior art tensioning devices are unsuited for tensioning polymer fencing systems which either have a plurality of wires or within which individual wires cannot be accessed. This prior art tensioning device is particularly unsuited for applying tension to fencing systems that must be tensioned concurrently along two parallel edges.

Prior art systems for tensioning polymer fencing are known. For example, the tensioning system disclosed in U.S. Pat. No. 5,409,196 to Specht includes a mounting batten designed to be fastened to a structural support post. The mounting batten forces the polymer fencing against a correspondingly formed elastic extrusion or metal form channel batten, thereby placing the fencing under tension. Similarly, U.S. Pat. No. 5,660,377 to Specht discloses a tensioner bar designed to be fastened to a structural support post containing a correspondingly shaped recess. The tensioner bar forces the polymer fencing into the correspondingly shaped recess, thereby placing the fencing under tension. These systems are generally effective for certain types of polymer fencing. However, they suffer from the disadvantages of requiring either a specially formed structural support post or multiple components, such as mounting battens and correspondingly shaped channel battens. Accordingly, there is need in the art for a tensioning system for a polymer fence member which can be used with a standard, unmodified support structure such as a fence post.

SUMMARY OF THE INVENTION

The tensioning device of the present invention is constructed to be used in conjunction with a standard support structure such as an ordinary fence post. The device of this invention is particularly suited for tensioning flexible members, such as the polymer fencing, having substantially parallel edges as well as a substantially flat web portion between its edges, as in disclosed in U.S. Pat. No. 4,465,263 to Robbins (now U.S. Pat. No. Re. 32,707) and U.S. Pat. No. 4,533,120. However, it should be appreciated that the device of this invention is suitable for tensioning any flexible member.

The tensioning device of the present invention includes a body constructed of a material of sufficient strength to provide the force required to tension a flexible member such as steel, iron, aluminum, plastics, rubberized compounds, composites, or suitable polymers. This device includes at least one rotary tensioner. Means for affixing the device to any standard support structure, such as an ordinary fence post, is also provided. In one embodiment of the invention, the body of the tensioning device comprises a single unitary structure. Also, in an especially preferred embodiment of the present invention, the body of the tensioning device is articulated such that the tensioner may be set at a separate angle relative to the vertical axis of the fence post.

In a preferred embodiment of the present invention, the rotary tensioner comprises a rotary member incorporating a slot of suitable length, width, and depth to allow insertion prior to rotation of an end of the particular flexible member into the cylindrical portion of the tensioner. The tensioning device further includes a locking mechanism for locking the rotary member to prevent it from rotating in an undesirable direction, i.e., in such a manner as to lose tension on the flexible member.

In one aspect of this invention, the tensioning device of this invention incorporates a single tensioner. In yet another aspect, the tensioning device of this invention incorporates dual tensioners for applying tension to the adjacent ends of a pair of flexible members.

Additional advantages and other novel features of the invention will be set forth in part in the description that follows and will become apparent to those skilled in the art either upon examination of the following or may be learned with the practice of the invention.

DETAILED DESCRIPTION OF THE INVENTION

Figure 1:
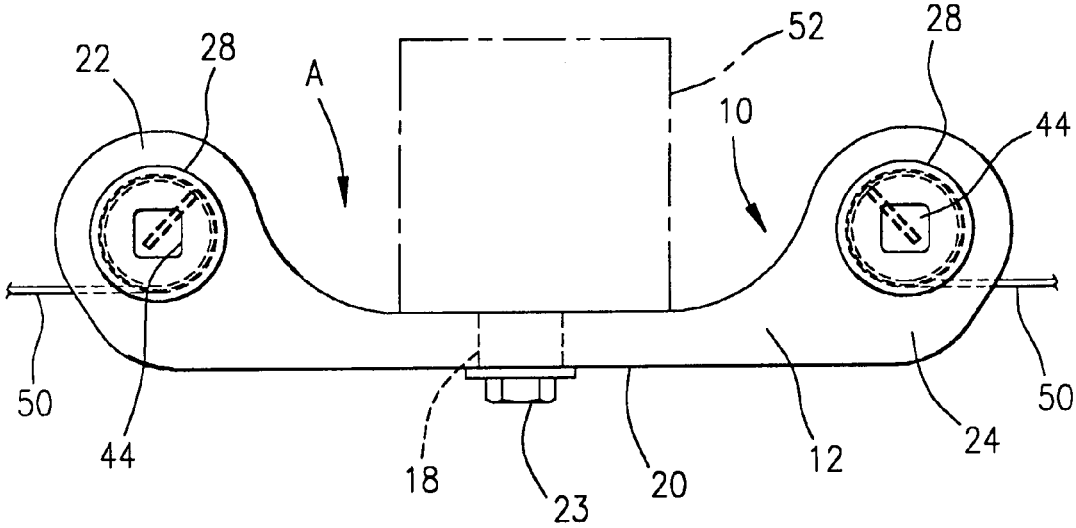
FIG. 1 is a top view of the tensioner with two tensioners.
Figure 2:
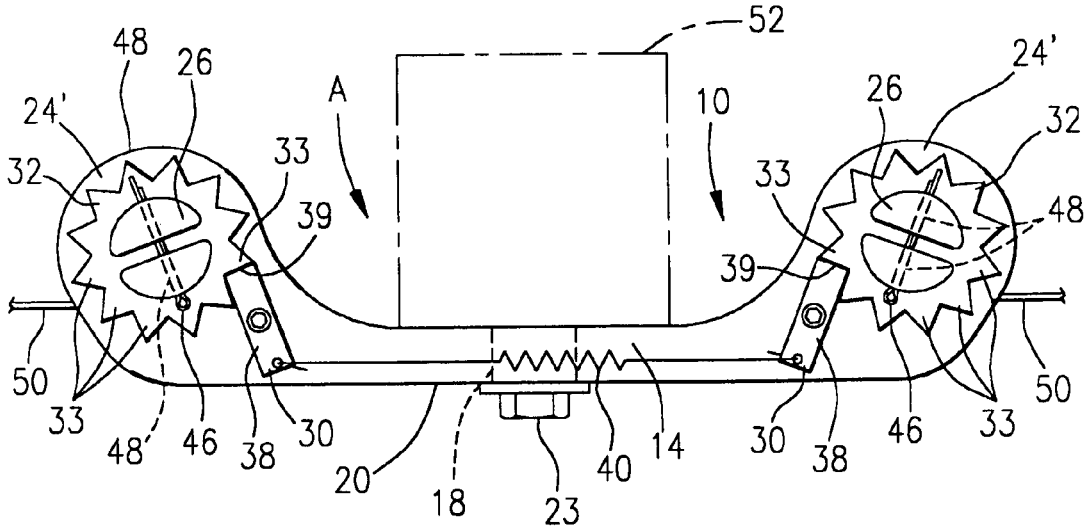
FIG. 2 is a bottom view of the tensioner with two tensioners.

Referring to FIGS. 1 and 2, the tensioning device 10 of this invention comprises a top plate 12 and a bottom plate 14. Top plate 12 and bottom plate 14 are separated by a substantially rectangular spacing plate 16. Shown in FIG. 3, spacing plate 16 contains an aperture 18 for receiving a fastener 23 for fastening the device 10 to a support structure 52, such as a fence post 52 or a retaining wall. Aperture 18 is used to fasten the tensioning device 10 to a support or fence post 52 and may be an elongated slot 18 allowing adjustment of the tensioning device 10 along a horizontal plane. However, depending upon the desired direction of adjustment it should be appreciated that an aperture of any suitable shape or size may be incorporated into the spacing plate 16.

Figure 3:
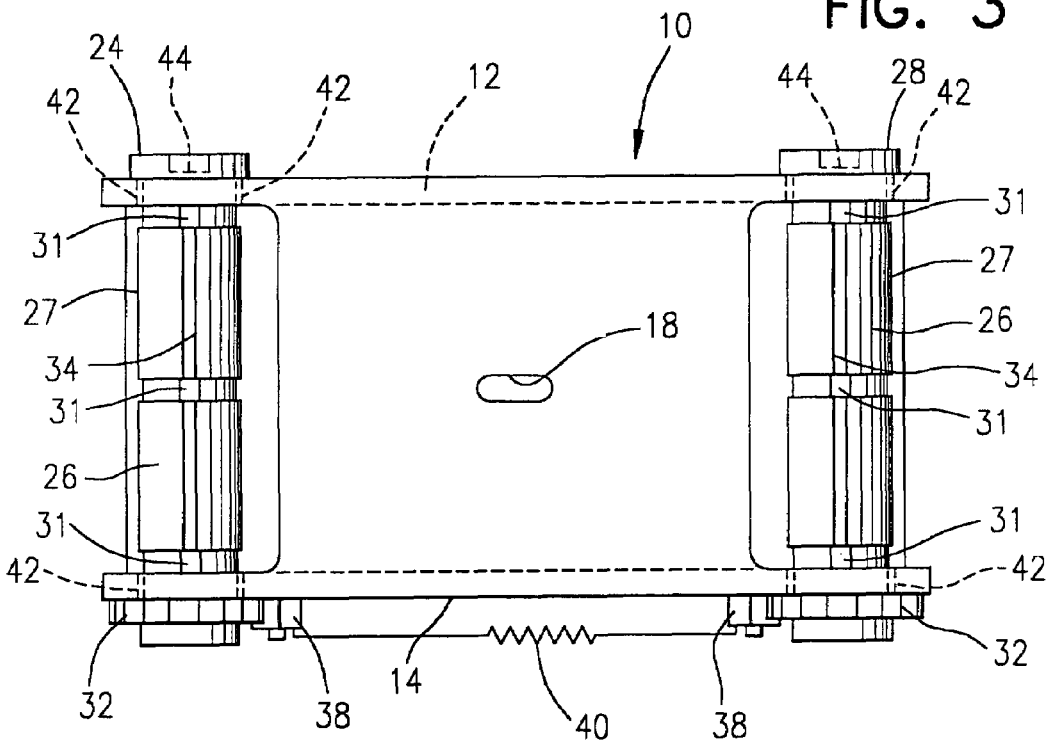
FIG. 3 is a front view of the tensioner with two tensioners.

In a preferred embodiment as shown in FIG. 2, the tensioning device 10 is substantially "C-shaped." Top plate 12 comprises a narrow central portion 20 which widens at ends 22 and 24. Bottom plate 14 is similarly shaped, comprising a narrow central portion 20' and widening at ends 22' and 24'. Ends 22, 22', 24, and 24' contain substantially aligned apertures 42 therethrough for rotatably receiving and supporting a rotary tensioner 26, as best seen in FIG. 3.

As those of skill in the art will appreciate, this design allows the interior of tensioning device 10 to engage or be positioned around a support structure such as a fence post 52. In this embodiment, the interior of the tensioning device 10 may be placed in close proximity to a support structure 52, such as a standard fence post, and affixed thereto by any suitable fastener, such as a bolt 23, lag screw 23, or other fastener of choice. However, it should be appreciated that many other configurations for the device 10 are possible depending upon the structure to which the device is to be affixed. For example, a substantially flat interior portion would be preferred if the tensioning device 10 was to be affixed to a substantially flat support structure, such as a wall. A substantially rectangular interior portion would be desirable if the device was to be affixed to a square fence post.

The tensioning device 10 includes at least one rotary tensioner 26. In a presently preferred embodiment of this invention best seen in FIGS. 1, 2 and 3, the device 10 includes a pair of tensioners 26, rotatably inserted into each opposing end 22, 22', 24, 24' of the tensioning device 10. Each tensioner 26 comprises a rotary member 27, rotatably inserted through the apertures 42 in top plate 12 and bottom plate 14. As seen in FIG. 3, tensioner 26 comprises a retainer flange 28 at one end of a substantially cylindrical body portion 27 and a locking mechanism 32 or ratchet 32, secured thereto at a second end, for locking the rotary tensioner 26 in place. The retainer or flange 28 may be of any shape suitable to prevent withdrawal of the rotary tensioner 26 from aperture 42 in top plate 12. Retainer or flange 28 includes an opening 44 formed in a shape suitable for insertion of a lever (not shown) with an end adapted to the shape of opening 44. By use of the lever, the rotary member 27 may be rotated to wind and thus to achieve tensioning of a flexible member 50 inserted therein.

Along its exterior cylindrical portion 27 includes slot 34 of an appropriate size and shape for insertion of a flexible member therein for tensioning. As will be appreciated, cylindrical portion 27 may be hollow or solid depending on the particular strength and weight requirements for the flexible member undergoing tensioning. Of course, the particular length, width, depth, and shape of slot 34 is dependent upon the size and shape of the flexible member to be inserted therein. The shape of slot 34 in the present invention extends the entire length of the exposed cylinder 27 and extends radially into the rotary tensioner cylinder 26. The shape of the slot 34 includes an enlarged width 31 at the ends and the midpoint of the slot 34 to accommodate a portion of a flexible member 50 or fencing material 50 which encloses the longitudinal wires therein.

Figure 4:
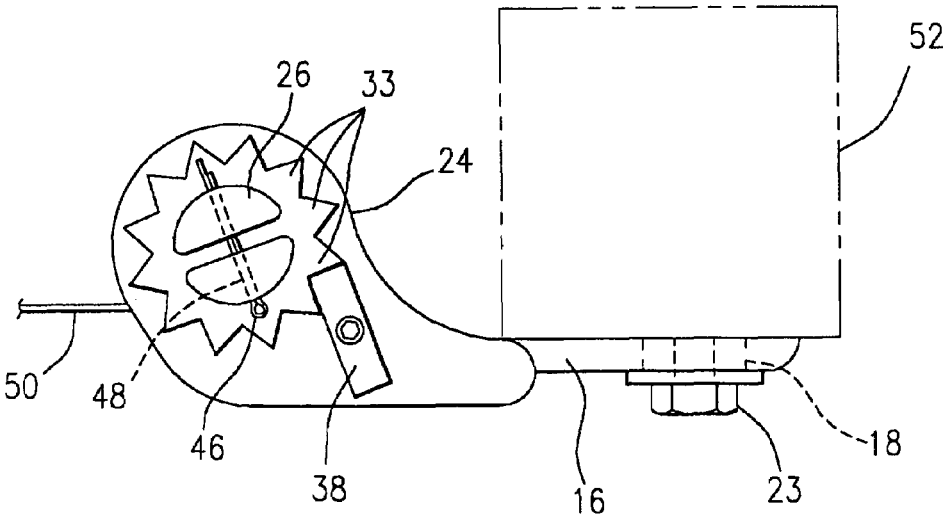
FIG. 4 is a bottom view of an embodiment of the device having only a single tensioner.

In a preferred embodiment of this invention, the locking mechanism comprises a ratchet wheel 32 and pawl 38 arrangement. As best seen in FIG. 4, the fence tensioner 10 includes a toothed ratchet wheel 32 secured for rotation with rotary member 27 and a substantially rectangular pawl 38 engageable at its proximal end 39 with the teeth 33 of the ratchet wheel 36. The need for these specific shapes will be discussed in greater detail below. Advantageously, ratchet wheel 32 also retains the rotary member 27 to prevent removal from the apertures 42. Pawl 38 is maintained in engagement with ratchet wheel 32 by engagement of the square proximal end 39 of pawl 38. The ratchet wheel 32 tooth 33 profile is neutral insofar as the lateral forces on the pawl 38 and tends not to latch or unlatch the pawl 38.

In one particular preferred embodiment, the tensioning device 10 of this invention includes a rotary tensioner 26 at each end of the device 10. In this embodiment, as best seen in FIGS. 2 and 3, spring 40 is connected to each of the pawls 38 at their distal end 30, thereby simultaneously urging the proximal ends 39 of pawls 38 into engagement with a mating tooth 33 on ratchet wheel 32. As it will be appreciated, in this manner it is possible to simultaneously apply tension to two flexible members with the device of this invention; each flexible member extends therefrom in opposing directions to form the fence. Further, because the dual means for tensioning a flexible member operate independently of one another, yet each of pawl members 38 are biased by spring 40, it is possible to apply tension to one flexible member 50 without undesirable loss of tension to a second flexible member 50.

It should be appreciated that the tensioning device 10 of this invention may be adapted to include a single tensioner 26 for situations whereby it is desirable to apply tension to a single flexible member, such as at a post or wall which terminates a fence line being erected. In this instance, as shown in FIG. 4, the device 10 may be provided with a single tensioner 26 and only one end portion of the top 12 and bottom 14 plates. The rectangular spacing plate 16 is shortened, and the aperture 18 is retained for mounting. All other aspects of the device are the same as previously described.

Figure 5:
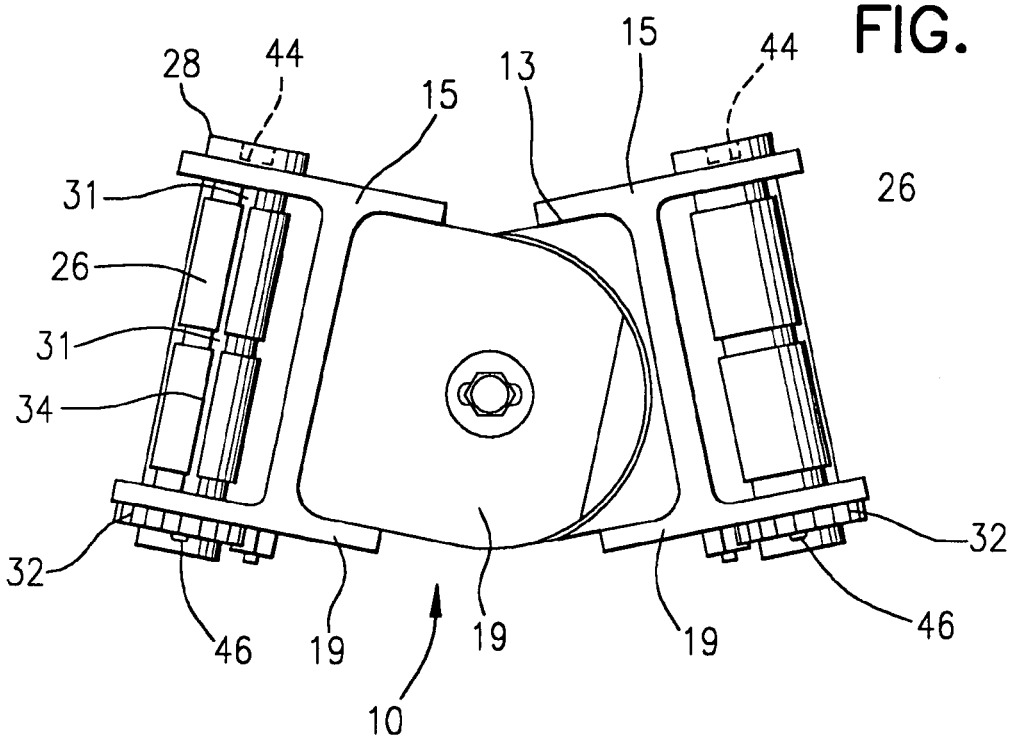
FIG. 5 is a front view of an embodiment of the device which is articulated to accommodate an uneven ground surface.

In an alternate embodiment of the invention, the body of the tensioning device 10 is articulated such that each tensioner 26 may be rotated relative to the attachment point of the device 10. In this embodiment, the body of the tensioning device 10 is articulated to allow each tensioner 26 to be adjusted approximately 30 degrees above or below a midline of the device 10. As best seen in FIG. 5, the body of the tensioning device 10 comprises two segments 13, each comprising a top plate 15 and a bottom plate 17 separated by spacing plate 19. As described above, top plate 15 and bottom plate 17 form a retaining means for a rotary tensioner 26. Thus, each segment 13 includes both a rotary tensioner 26 at a first end and a connecting means 23 or bolt 23 for hingedly connecting to another segment 13. Connecting means 23 may be any suitable connector such as a bolt, lag bolt, or screw, which advantageously may be also utilized to attach the tensioning device 10 to a support structure 52 such as a fence post 52.

The two overlapping portions of spacing plate 19 are interconnected to each other by a bushing 21. Bushing 21 is formed with an elongated hole 18 or aperture 18 in its center to permit insertion of a bolt 23, lag bolt 23 or screw 23. The elongated hole 18 permits the attachment of the tensioning device 10 onto a post 52 and the tensioner 10 relative to the post. The tension in the first flexible member 50 is increased until the device 10 shifts to a first end of elongated hole 18 and, thereafter, the second flexible 50 member is tightened until the bolt 23 or other connector is centered in the elongated slot 18 without causing a bind with the bolt 23. Thereby, the tensions of the two flexible members 50 are equalized.

In embodiments of the invention best shown in FIGS. 2 and 4, toothed ratchet wheel 32 may be releasably secured to rotary member 27. In this embodiment, rotary member 27 extends beyond the tensioning device 10 a sufficient distance to allow capture of the ratchet wheel 32 between the tensioning device 10 and any suitable retaining means. Accordingly, ratchet wheel 32 may be placed over rotary member 27 and secured with a cotter pin 46 passed through apertures 48 in an end of rotary member 26.

Reference is now made to use of a presently preferred embodiment of the present invention. The interior curved portion A of tensioning device 10 is placed in contact with support structure 52, such as a fence post 52, and loosely affixed thereto with a suitable fastener, such as a standard lag bolt or wood screw 23, of appropriate size and strength inserted through aperture 18 in spacing plate 16 into said support structure 52. A flexible member 50 such as the polymer fencing is inserted into slot 34 of each rotary member 26.

A lever, such as a suitable ratcheting lever (not shown), may be inserted into opening 44 contained within retainer flange 28 and used to turn rotary tensioner 27, thereby applying a desired amount of tension to said flexible member 50. As rotary tensioner 27 is turned, pawl 38 comes into contact with and engages a tooth 33 of ratchet wheel 32. Pawl 38 consecutively engages the teeth 33 of ratchet wheel 32 to prevent slippage and, hence, any loss of tension in the flexible members 50.

It must be appreciated that the square-ended 39 shape of pawl 38 and ratchet wheel 32 having ratchet teeth 33 to engage the square end 39 of pawl 38 provide an additional advantage in tensioning a flexible member 50. Due to the shape generally exhibited by the teeth of most ratchet wheels, ordinary pawl and ratchet systems allow a certain amount of play or backlash as the pawl passes over one tooth of the ratchet wheel and, by reversing rotation of the ratchet wheel to engage the pawl in the ratchet tooth, locks between that tooth and the adjacent tooth on the wheel. For most systems incorporating pawl/ratchet systems, this is of no concern. However, in this application described herein, any amount of play before the pawl 38 locks the ratchet 32 in place would undesirably result in loss of tension in the flexible member 50 being tensioned. In contrast, in this invention the angle of the teeth of ratchet wheel 32 exactly matches the proximal end 39 of pawl 38 in the locked position. Therefore, as best seen in FIG. 2, at the instant pawl 38 passes over the tip of a tooth 33 of ratchet wheel 32, pawl 38 is immediately urged into engagement with ratchet wheel 32 with no slippage or loss of tension in the flexible member being tensioned.

The process is repeated with the second flexible member 50. As it will be appreciated from FIGS. 5 and 6, in the process of applying tension, the tensioning device 10 will automatically adopt the same angle as the contour of the land along which the flexible members 50 are stretched. It should also be appreciated that aperture 18 allows the tensioning device 10 to move laterally during tensioning if greater tension is applied to one side or the other of the device 10. Advantageously, this allows the considerable stress caused by tensioning the opposed flexible members 50 to be placed upon the tensioning device 10, rather than on the support structure. Upon achieving suitable tension in the opposed flexible members 50, the fastener 23 maybe tightened, completing the process. Moreover, it should also be appreciated that, it is possible to return and apply additional tension to the flexible members 50, thereby accommodating for loss of tension over time caused by stretching of the flexible members 50.

Figure 6:
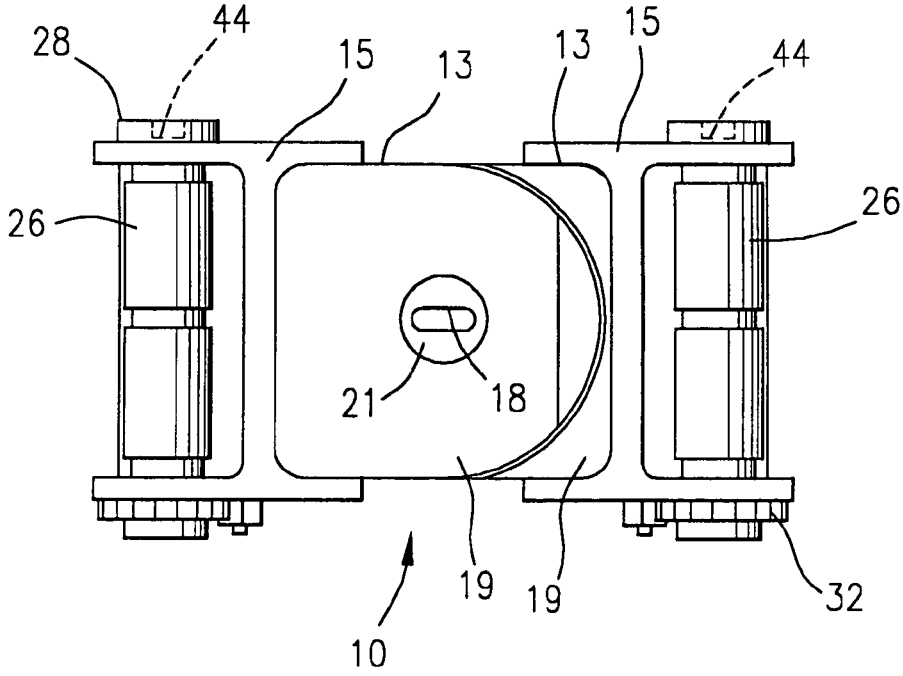
FIG. 6 is a front view of the articulated embodiment with a level shape.

It should also be appreciated that by use of the articulated embodiment of the invention as shown in FIGS. 5 and 6, during tensioning, it is possible to adjust the angle at which each tensioner 26 is placed relative to a fence post 52, further improving the ability of both the tensioning device 10 and flexible members 50 attached thereto to adapt to the contours of the land on which fencing is placed.

Finally, as noted above in a preferred embodiment, the tensioning device 10 is substantially C-shaped. As best seen in FIG. 2, this configuration results in rotary tensioner 26 being offset in relation to spacing plate 16.

The foregoing description of various preferred embodiments of the invention has been presented for purposes of illustration and description. It is not intended to be exhaustive or to limit the invention to the precise form disclosed. Obvious modifications or variations are possible in light of the above teachings. The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention when interpreted in accordance with the breadth to which it is fairly, legally and equitably entitled.

What is claimed is:

1. A device tensioning a flexible fencing member comprising a web, relative to a structure, the device comprising:

a body for engaging a support member;

said body supporting at least one tensioner, said tensioner rotationally supported by said body;

said tensioner having an axis of rotation extending longitudinally of said tensioner and extending through said support member;

said tensioner comprising at least one end;

said end comprising a ratchet having a plurality of engaging surfaces extending outwardly from said axis of rotation;

a depression formed within and surrounded by said at least one end of said tensioner for rotation of said tensioner, said depression formed and dimensioned to accept a driving member inserted therein to rotate said tensioner;

a pawl having an axis extending the length of said pawl and having a plane surface on one end thereof, said plane surface perpendicular to said axis, of said pawl supported on said body and pivotally mounted on said support structure and moveable to engage said plane surface thereof with one of said engaging surfaces of said ratchet, thereby blocking rotational movement of said tensioner in one direction;

said tensioner further having an elongated opening formed therein extending radially outwardly from and along said axis of rotation, said opening further being enlarged in cross-sectional width at the two ends and the middle of said elongated opening to define enlarged opening portions to accept a thickened web portion at the edges of and the middle of said web of said flexible fencing member, when inserted into said opening;

each of said enlarged opening portions arranged parallel to the other of said opening portions;

the outer surface of said tensioner further comprising a plurality of recessed channels, each of said channels formed into said outer surface and circumscribing and correspondingly intersecting one of said enlarged opening portions;

whereby said flexible fencing member may be inserted into said opening in said tensioner and said thickened web portions of said flexible fencing member proximate each edge and said middle of said flexible fencing member are resident within said enlarged opening portions, thereby ensuring surface-to-surface engagement between said flexible fencing member and said opening in said tensioner and said plurality of channels formed in said outer surface of said tensioner, insuring a large engagement area with said fencing member when said flexible fencing member is engaged within and wrapped around said tensioner.

2. The device tensioning a flexible fencing member relative to a structure of claim 1 wherein said pawl is biased toward a position wherein said pawl plane surface is blockingly engaged with said tensioner.

3. The device tensioning a flexible fencing member relative to a structure of claim 2 wherein said bias is provided by a tension spring connected to said pawl and to said body.

4. The device tensioning a flexible fencing member relative to a structure of claim 1 wherein said body is unitary.

5. The device tensioning a flexible fencing member relative to a structure of claim 1 wherein said body supports a pair of tensioners for rotation.

6. The device tensioning a flexible fencing member relative to a structure of claim 5 wherein said body is unitary.

* * * * *